US005722338A

United States Patent [19]

Douyasu

[11] Patent Number: 5,722,338

[45] Date of Patent: Mar. 3, 1998

[54] METHOD AND APPARATUS FOR PREVENTING SEAM FROM RAVELING IN DOUBLE CHAIN STITCH SEWING MACHINE

[75] Inventor: Osamu Douyasu, Osaka, Japan

[73] Assignee: Pegasus Sewing Machine Mfg. Co., Ltd., Osaka, Japan

[21] Appl. No.: 801,358

[22] Filed: Feb. 19, 1997

[30] Foreign Application Priority Data

Feb. 28, 1996 [JP] Japan ..... 8-067374

[51] Int. Cl.[6] ..... D05B 1/10; D05B 65/00

[52] U.S. Cl. ..... 112/475.17; 112/165; 112/291

[58] Field of Search ..... 112/163, 165, 112/200, 292, 295, 197, 475.17, 294, 296, 297, 298

[56] References Cited

U.S. PATENT DOCUMENTS

| | | | |
|---|---|---|---|
| 3,386,402 | 6/1968 | Ross | 112/292 |
| 3,867,892 | 2/1975 | Ciecior et al. | 112/288 |
| 3,871,307 | 3/1975 | Scott et al. | 112/296 X |
| 3,894,502 | 7/1975 | Hager et al. | 112/291 X |
| 5,417,173 | 5/1995 | Mitsuji | 112/291 X |

*Primary Examiner*—Ismael Izaguirre
*Attorney, Agent, or Firm*—Jones, Tullar & Cooper, P.C.

[57] ABSTRACT

The method and apparatus for preventing seam from raveling in a double chain stitch sewing machine of the invention are applied mainly in sewing of cloth by a double chain stitch sewing machine with multiple needles, and when nearing the end of sewing for forming a double chain stitch S by collaboration of a plurality of needles 5, 6 and a looper 3, a looper thread 10 consecutive from the cloth W to the looper 3 is engaged with a hook 15, and in this state, consequently, needle threads 8, 9 consecutive to the needles 5, 6 from the cloth W through the looper 3, and the looper thread 10 consecutive to the looper 3 from the cloth W are cut off, and the looper thread 10 engaged with the hook 15 is also cut off simultaneously or before or after this cutting, and therefore the looper thread 10 consecutive to the sewing end of the cloth W is set in discontinuous state, and raveling of sewing thread is securely prevented, while the length of the thread end consecutive to the sewing end is shortened, so that a sewn product of an attractive appearance may be obtained.

11 Claims, 4 Drawing Sheets

METHOD AND APPARATUS FOR PREVENTING SEAM FROM RAVELING IN DOUBLE CHAIN STITCH SEWING MACHINE

BACKGROUND OF THE INVENTION

1. Field of the Invention

The present invention relates to a method and apparatus for preventing seam from raveling applied in sewing of cloth mainly by double chain stitch sewing machine with multiple needles, and more particularly to a method of preventing the sewing thread from raveling from the sewing end of a seam, when sewing a cloth by a double chain stitch sewing machine comprising a plurality of needles, and a looper for forming a double chain stitch through collaboration with the needles by oscillating laterally from the right side of the needles, and an apparatus for realizing such method.

2. Description of the Prior Art

When sewing a cloth by this kind of double chain stitch sewing machine, if a double chain stitch as indicated by seam symbol of, for example, 406 is formed in the cloth, the sewing thread of this seam is raveled sequentially when the looper thread is pulled from the sewing end, and the quality of sewn product is lowered.

To prevent the sewing thread of the double chain stitch from raveling from the sewing end, hitherto, various methods have been known, including (a) a general method of sewing by the condensed stitch at several stitches just before the sewing end, (b) a method of making the sewing thread hard to ravel by changing the tension balance of the sewing thread at the sewing end as disclosed in Japanese Laid-open Patent No. 1-31745 (Japanese Patent Publication No. 6-102107) and Japanese Laid-open Patent No. 5-208082 (U.S. Pat. No. 5,381,745), and (c) a method, as disclosed in Japanese Laid-open Patent No. 6-233877, of disposing a looper thread hook slidably for holding the looper thread behind the looper of a double chain stitch sewing machine, and comprising the steps of stopping the operation of the sewing machine once immediately before the sewing end, holding the looper thread by the looper thread hook, resuming the operation of the sewing machine in this state to sew one stitch, cutting both needle threads and loop thread after the sewing, and removing the cloth from the sewing machine while holding the looper thread by the looper thread hook, thereby varying the entangling state of the needle thread and looper thread so that the sewing thread may be hard to ravel.

In the above methods (a) and (b), raveling of the sewing thread from the sewing end is not prevented securely, and in the method (c), a long end of the cut thread hangs loose from the cloth, and the appearance of the sewn product is poor, or to improve the appearance, it required a manual labor of clipping the loose end of the thread off the cloth after finishing the sewing process.

SUMMARY OF THE INVENTION

The invention is presented in the light of the above prior arts, and it is hence an object thereof to provide a method and apparatus for preventing seam from raveling in a double chain stitch sewing machine capable of obtaining sewn products of high quality and good appearance, for securely preventing the sewing thread from raveling from the sewing end of double chain stitch formed in the cloth by a double chain stitch sewing machine, while shortening the thread end consecutive to the sewing end, without requiring manual labor for clipping off the thread end after sewing.

To achieve the object, the invention provides a method for preventing seam from raveling in a double chain stitch sewing machine characterized by hooking and engaging a looper thread consecutive to a looper from a cloth at a left side position of needles by engaging means when the looper is at a position advanced leftward near the sewing end point at the time of sewing of the cloth by a double chain stitch-sewing machine comprising a plurality of needles moving vertically as being disposed laterally, and the looper moving laterally from the right side in the parallel direction of the plurality of needles, for forming a double chain stitch by collaboration of the needles and the looper, forming a long loop in the looper thread engaged in the engaging means by driving the sewing machine for one stitch in this state, cutting off a plurality of needle threads consecutive to the needles from the cloth through the looper and the looper thread consecutive to the looper from the cloth between the cloth and the looper, and cutting off the looper thread engaged with the engaging means at the engaging portion simultaneously with said cutting or before or after it.

The apparatus for preventing seam from raveling in a double chain stitch sewing machine used in the invention comprises a plurality of needles moving vertically as being disposed laterally, a looper moving laterally from the right side of the plurality of needles for forming a double chain stitch by collaboration with the needles, looper thread engaging means for engaging with the looper thread consecutive to the looper from the cloth at a left side position from the needle drop point in the sewing machine bed when the looper advances leftward in the parallel direction of-the needles, a first cutter for cutting off the looper thread engaged with the looper thread engaging means at the engaging portion, and a second cutter for cutting each one of the plurality of needle threads consecutive to the needles from the cloth through the looper and the looper thread consecutive to the looper from the cloth between the cloth and the looper.

According to the invention having such features, when approaching the end of sewing for forming double chain stitches in the cloth through collaboration of the plurality of needles and the looper, with the looper thread consecutive from the cloth to the looper being engaged with the engaging means, by cutting off the engaging portion of the looper thread engaged with the engaging means simultaneously with or before or after the process of cutting off each of the plurality of needle threads consecutive to the needles from the cloth to the looper and the looper thread consecutive from the cloth to the looper, the looper thread consecutive to the sewing end of the cloth becomes discontinuous, and one thread end being cut off can be smoothly pulled out of the needle thread loop, while the other thread end cannot be pulled out of the needle thread loop as being left over at the cloth side. Therefore, it is possible to prevent securely raveling as the looper thread remaining in the loop state at the sewing end of cloth is pulled out and the looper thread loop is being pulled out sequentially from the needle thread loop at the end of sewing. Moreover, the thread end consecutive to the sewing end of the cloth can be shortened by cutting off, and manual processing of clipping off the thread end at the end of sewing is not necessary, and the sewn product of high quality and attractive appearance can be obtained efficiently.

Other objects and effects of the invention will be clarified from the embodiments described below in conjunction with the accompanying drawings.

PREFERRED EMBODIMENTS OF THE INVENTION

Figure 1:
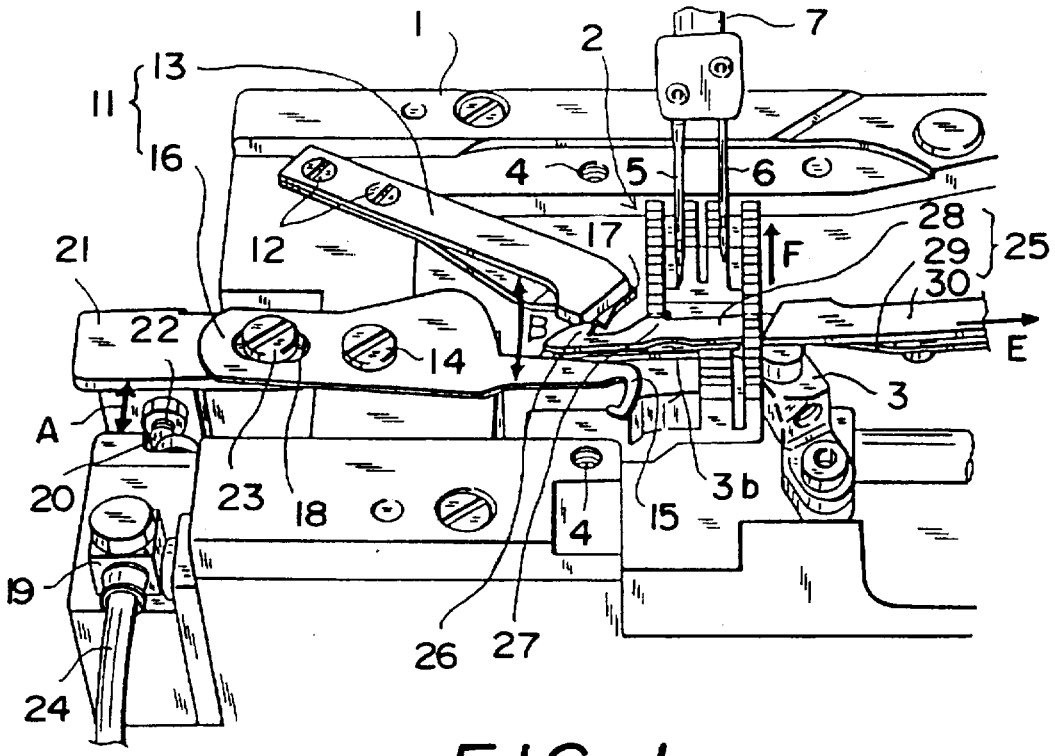
FIG. 1 is a perspective view of essential parts of a cylinder bed type double chain stitch sewing machine according to the invention.

Referring now to the drawings, preferred embodiments of the invention are described in detail below.

FIG. 1 shows the bed portion of a cylinder bed type double chain stitch sewing machine according to the invention. A cylinder bed 1 of this sewing machine comprises a feed dog 2 for feeding the cloth in the direction of arrow F by moving vertically and longitudinally, a looper 3 making elliptical motions laterally and longitudinally, and a throat plate (not shown) fixed through a screw hole 4, and above this cylinder bed 1 is disposed a needle bar 7 fitting needles 5, 6 parallel laterally. The right and left needles 5, 6 moving vertically penetrating through the throat plate along with vertical motion of the needle bar 7 and the looper 3 making elliptical motions laterally and longitudinally from the right side of the parallel direction of these needles 5, 6 collaborate, and form a double chain stitch S in the cloth W by needle treads 8, 9 and looper thread 10 as shown in FIG. 2 to FIG. 8.

Moreover, in this sewing machine, a first cutter 11 is disposed at the left side of the needle drop point, that is, the position of vertical motion of the two needles 5, 6 in the sewing machine bed. This first cutter 11 is composed of a first receiving knife 13 extended nearly to the needle drop point along the lower side of the throat plate, being fixed to the rear part of the cylinder bed 1 through a screw 12, a first hook knife 16 fitted rotatably almost to the front side of the cylinder bed 1 through a step screw 14, having a hook 15 formed at the leading end as looper thread engaging means, and a pressing spring 17 for pressing the hook 15 to the lower side of the receiving knife 13 when cutting. At the rear end of the first hook knife 16 of the first cutter 11, a slot 18 is formed.

At the left end of the cylinder bed 1, an air cylinder 19 is provided as the forward and backward drive mechanism, and an operation piece 21 is fixed to a piston rod 20 of the air cylinder 19 so as to be adjustable in position through a screw 22. A pin 23 provided in the operation piece 21 is fitted into the slot 18 formed in the first hook knife 16, and by the air pressure supplied into the air cylinder 19 through a pipe 24 from a high pressure air source such as compressor not shown in the drawing, the piston rod 20 is driven back and forth in the direction of arrow A, so that the first hook knife 16 is pivoted in the direction of arrow B about the step screw 14 through the operation piece 21.

At the right side of the needle drop point in the cylinder bed 1, a second cutter 25 is provided. This second cutter 25 is composed of a second hook knife 28 forming hooks 26, 27 at two positions in the leading end, and moving reciprocally laterally along the upper side of the blade portion **3*b* of the looper 3, and a second receiving knife 30 provided at the backward position of the hook knife 28, being pressed against the second hook knife 28 by a pressing spring 29. The second hook knife 28 of the second cutter 25** is also driven back and forth in the direction of arrow E by forward and backward moving mechanism such as air cylinder and solenoid not shown in the drawing.

In this apparatus for preventing seam from raveling in the cylinder bed type double chain stitch sewing machine having such constitution, the ravel preventing operation of sewing thread at the end of sewing is described below by referring to FIG. 2 through FIG. 8.

Figure 2:
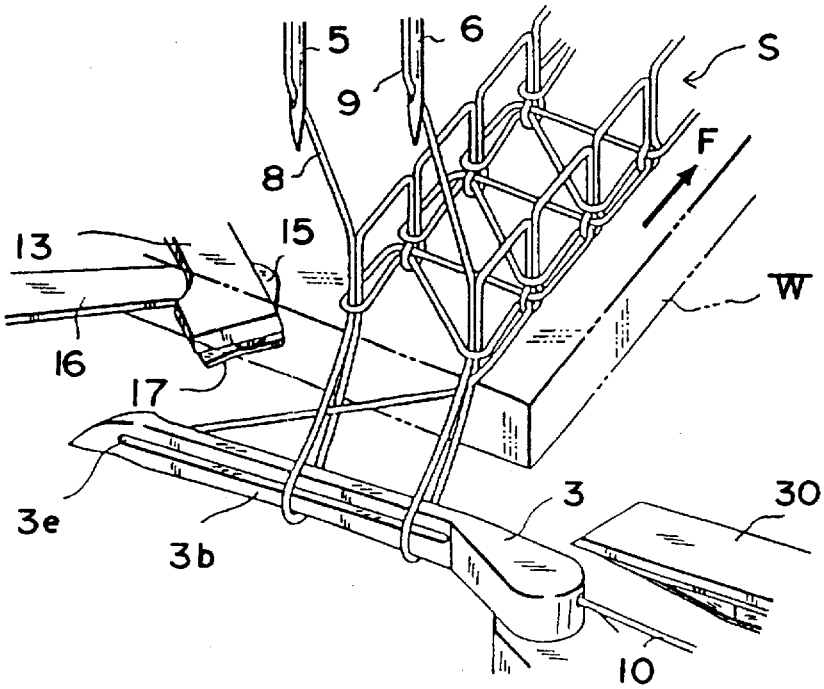
FIG. 2 is a magnified perspective view of essential parts showing a first state at the end of sewing by the same sewing machine.
Figure 3:
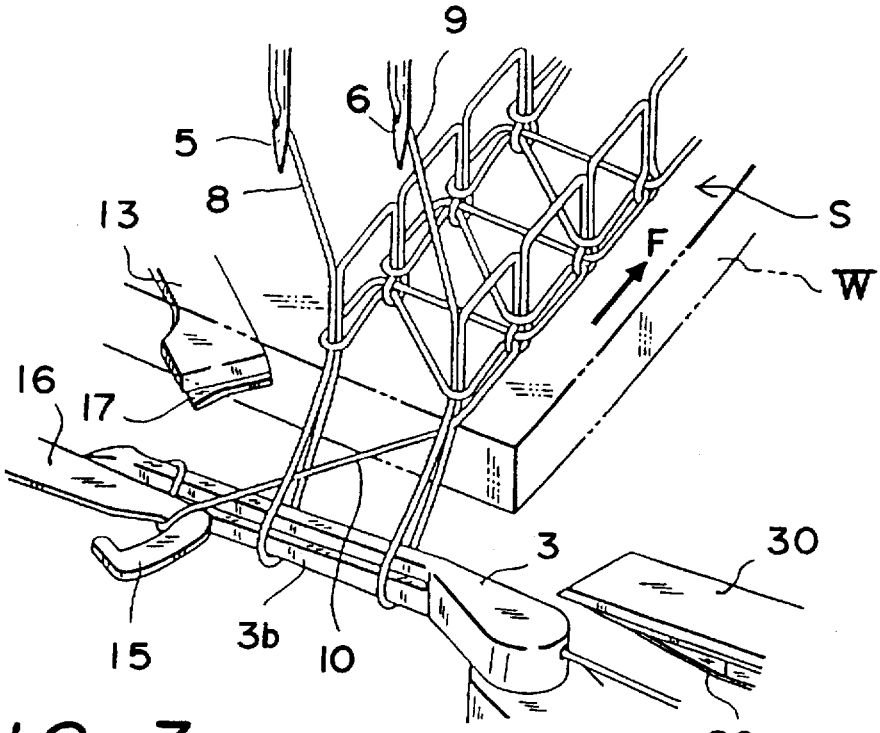
FIG. 3 is a magnified perspective view of essential parts showing a second state at the end of sewing by the same sewing machine.

As shown in FIG. 2, the cloth W set on the throat plate is fed in the direction of arrow F by the feed dog 2, and a double chain stitch S of seam symbol 406 is formed in the cloth W by needle threads 8, 9 and looper thread 10 passed respectively through the right and left needles 5, 6 and looper 3. Nearing the sewing end point, when the needles 5, 6 climb up almost to the top dead center and the looper 3 is nearly at the left dead center, the air cylinder 19 is actuated to turn the first hook knife 16 in the clockwise direction, and the hook 15 at the leading end of the first hook knife 16 moves across the front side above the blade portion **3*b* of the looper 3 between the eyelet 3*e* of the looper 3 and the left needle 5 from behind the looper 3, and hooks to be engaged with the looper thread 10 consecutive to the eyelet 3*e* of the looper 3 from the cloth W as shown in FIG. 3**.

Figure 4:
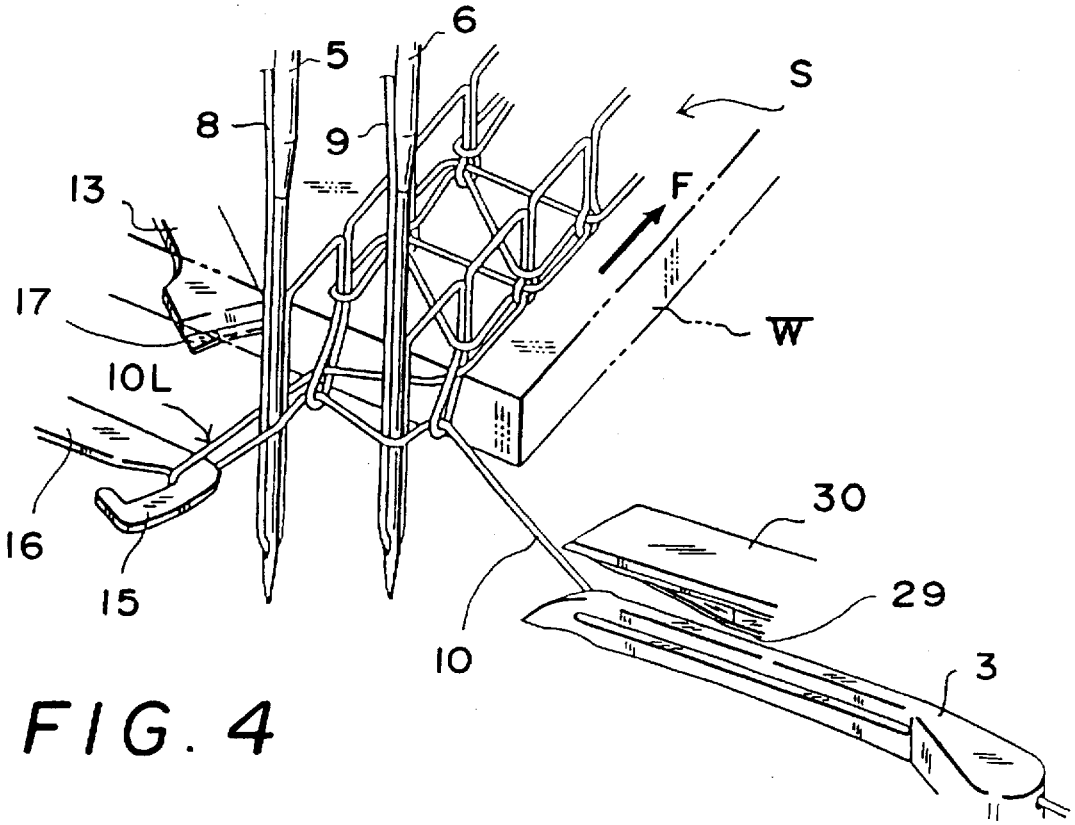
FIG. 4 is a magnified perspective view of essential parts showing a third state at the end of sewing by the same sewing machine.
Figure 5:
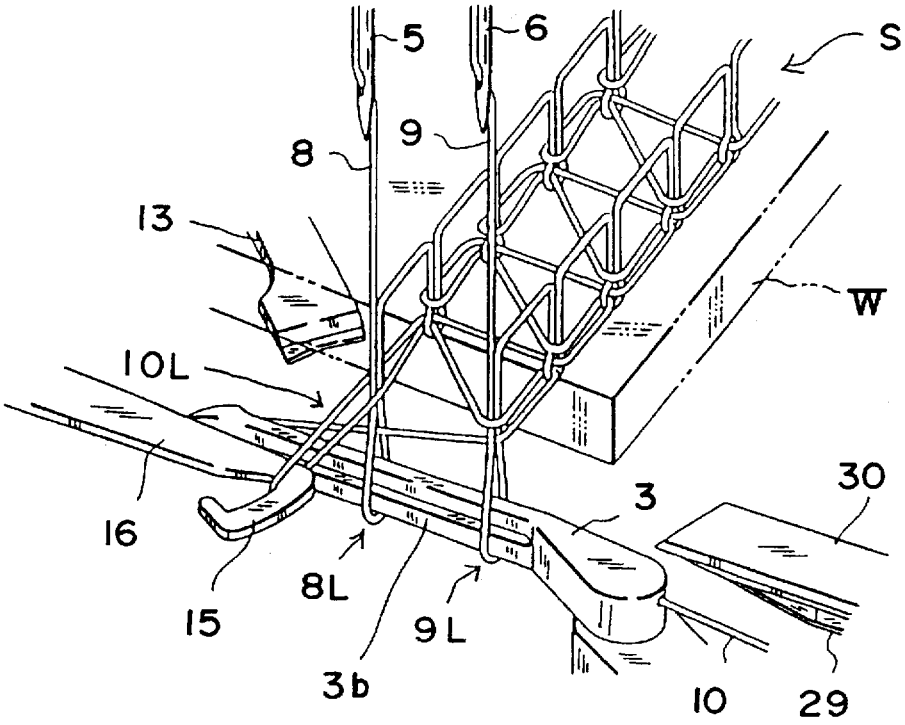
FIG. 5 is a magnified perspective view of essential parts showing a fourth state at the end of sewing by the same sewing machine.

In succession, the right and left needles 5, 6 fall into a triangular space of threads formed by the looper thread 10, blade portion **3*b* of the looper 3, and needle threads 8, 9, and the looper 3 moves back rightward through the front side of the needles 5, 6, and, as shown in FIG. 4, the looper thread 10 is engaged at a forward position of the needle 5 by the hook 15, and a slightly long loop 10L is formed. In FIG. 5, the looper 3 picks up new needle thread loops 8L, 9L formed by the needles 5, 6 moving up through the bottom dead center while advancing leftward at the rear side of the needles 5, 6 through the right dead center, showing the state of advancing almost one stitch from the state in FIG. 2. Herein, the longer loop 10L of the looper thread 10 engaged with the hook 15 is kept in engaged state slightly above the looper 3**.

Figure 6:
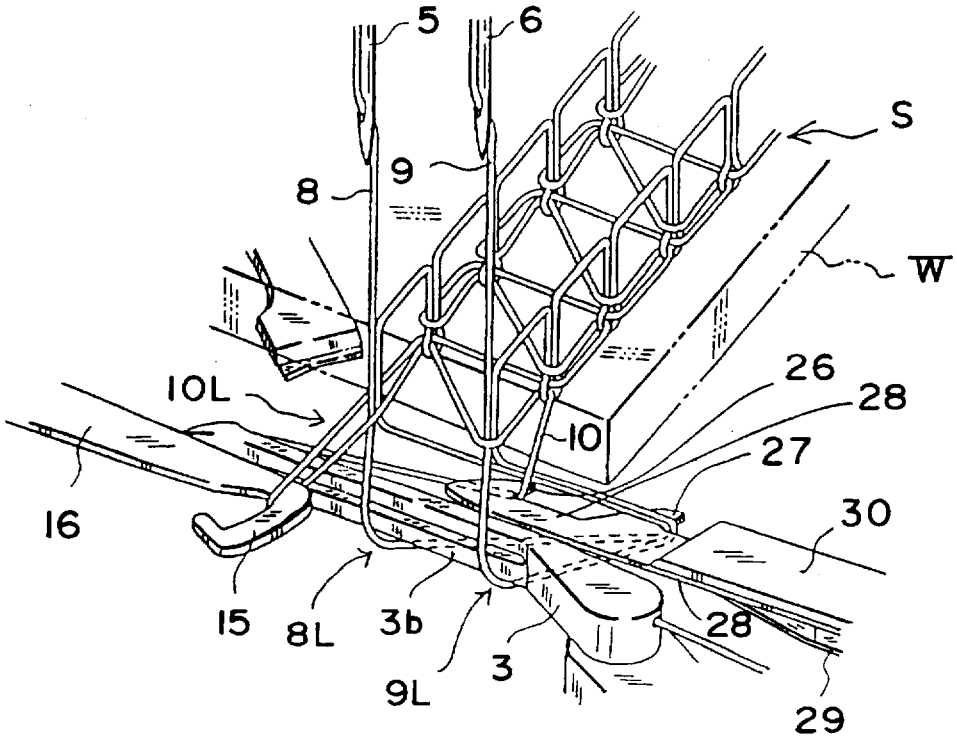
FIG. 6 is a magnified perspective view of essential parts showing a fifth state at the end of sewing by the same sewing machine.
Figure 7:
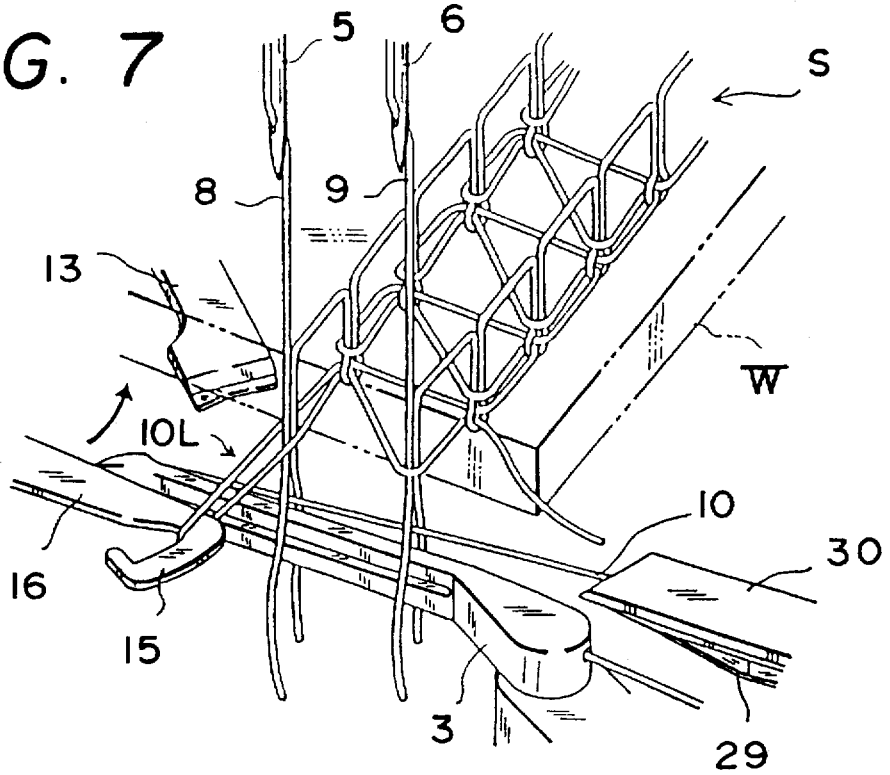
FIG. 7 is a magnified perspective view of essential parts showing a sixth state at the end of sewing by the same sewing machine.

Consequently, the second hook knife 28 in the second cutter 25 is reciprocally moved laterally, and, as shown in FIG. 6, the looper thread 10 consecutive from the cloth W to the looper 3 is hooked by the hook 26 at its leading end, and the two needle threads 8, 9 extending downward of the blade portion **3*b* of the looper 3 are hooked by the hook 27, and then in collaboration with the receiving knife 30, these threads 10, 8, 9 are cut off at the right side of the seam S. Of the cut-off threads, the cut thread end at the side consecutive to the looper 3 of the looper thread 10 engaged with the hook 26 is elastically pinched and held between the second hook knife 28 and pressing spring 29**.

Figure 8:
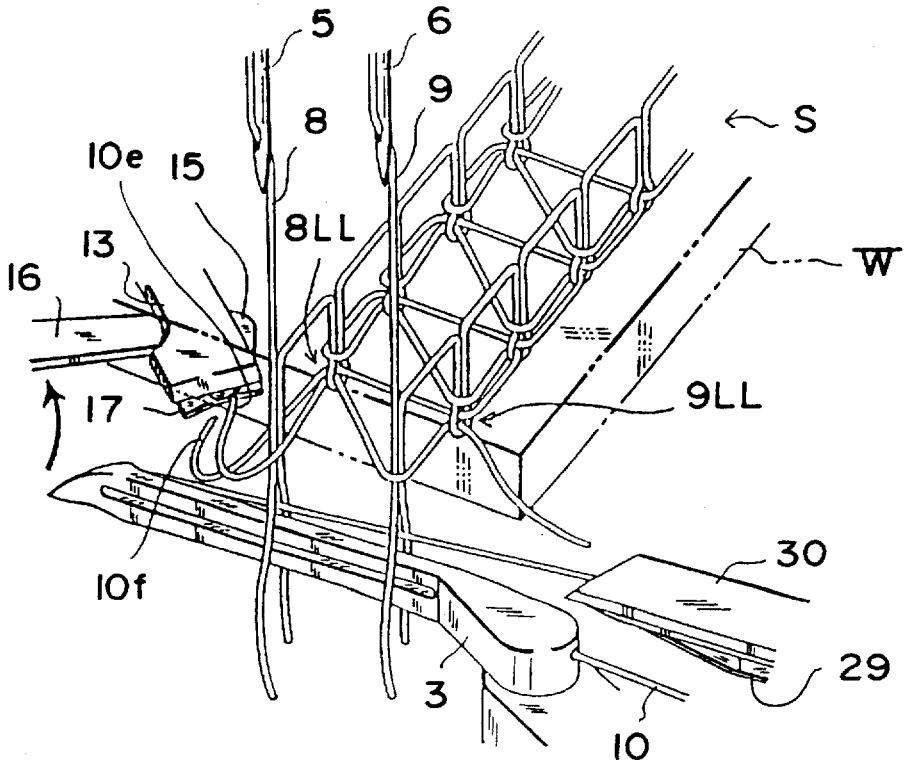
FIG. 8 is a magnified perspective view of essential parts showing a seventh state at the end of sewing by the same sewing machine.

Successively, the air cylinder 19 is actuated, and the first hook knife 16 at the first cutter 11 is turned counterclockwise as shown in FIG. 8 until the hook 15 is returned to the position of the receiving knife 13, then the engagement portion of the looper thread 10 engaged with the hook 15 is cut off. As a result, the other cut loop thread end **10*f* remaining consecutively to the swing end of the cloth W is short, and the other separated cutoff loop thread end 10*e* is at the pressing spring 17 side of the hook 15, and is pinched and held between the first hook knife 16 and pressing spring 17**.

The both thread ends **10*e*, 10*f* thus being cut off are not continuous, and when the cloth W is removed from the sewing machine, the thread end 10*e* pinched and held between the first hook knife 16 and pressing spring 17 is pulled out of the loops 8LL, 9LL of needle threads at the end of sewing, while the thread end 10*f* remaining consecutively to the cloth W side is not pulled out, so that raveling does not occur. Besides, the thread end 10*e* being cut off and pinched and held between the first hook knife 16 and pressing spring 17 is released when the hook knife 16** turns the next time, and it may be removed, at this time, by a waste thread suction device or the like.

In this embodiment, in thread cutting action, the second cutter 25 is operated earlier than the first cutter 11, but they may be operated simultaneously or in reverse order.

Driving of the sewing machine for one stitch and control of driving of the cutters 11, 15 are not specifically described, but it is possible to employ various control means used in existing sewing machines such as rotation control device of motor and control depending on the detection signal from rotation detector mounted on sewing machine main shaft.

As the forward and backward driving mechanism of the cutters 11, 25, the air cylinder is used in the embodiment, but solenoid, hydraulic cylinder or others may be also employed.

The entire disclosure of Japanese Patent Application No. 8-67374 filed on Feb. 28, 1996, including specification, claims, drawings and summary are incorporated herein by reference in its entirety.

What is claimed is:

1. A method for preventing seam from raveling in a double chain stitch sewing machine having a plurality of needles moving vertically as being disposed laterally, and a looper moving laterally from a right side in the parallel direction of the plurality of needles, for forming a double chain stitch by collaboration of the needles and the looper, comprising the steps of:

hooking and engaging a looper thread consecutive to a looper from a cloth at a left side position of needles by engaging means when the looper is at a position advanced leftward near the sewing end point at the time of sewing of the cloth by said double chain stitch sewing machine, forming a long loop in the looper thread engaged in the engaging means by driving the sewing machine for one stitch in this state, cutting off a plurality of needle threads consecutive to the needles from the cloth through the looper and the looper thread consecutive to the looper from the cloth between the cloth and the looper, and cutting off the looper thread engaged with the engaging means at the engaging portion simultaneously with this cutting or before or after it.

2. An apparatus for preventing seam from raveling in a double chain stitch sewing machine comprising:

a plurality of needles moving vertically as being disposed laterally, a looper moving laterally from the right side of the plurality of needles for forming a double chain stitch by collaboration with the needles, looper thread engaging means for engaging with the looper thread consecutive to the looper from the cloth at a left side position from the needle drop point in the sewing machine bed when the looper advances leftward in the parallel direction of the needles, a first cutter for cutting off the looper thread engaged with the looper engaging means at the engaging portion, and a second cutter for cutting each one of the plurality of needle threads consecutive to the needles from the cloth through the looper and the looper thread consecutive to the looper between the cloth and the looper.

3. An apparatus for preventing seam from raveling in a double chain stitch sewing machine of claim 2, wherein the first cutter is designed to cut off the engagement portion of the looper thread engaged with the looper engaging means at a position left side of the needle drop point in the sewing machine bed, and the second cutter is provided at the right side of the needle location in the sewing machine bed.

4. An apparatus for preventing seam from raveling in a double chain stitch sewing machine of claim 3, further comprising a control mechanism for maintaining the engagement state as it is when driving the sewing machine for one stitch in the state of engagement with the looper thread by the looper thread engaging means, and then operating the first and second cutters.

5. An apparatus for preventing seam from raveling in a double chain stitch sewing machine of claim 3, wherein the first cutter is composed of a hook knife having a forward and backward driving mechanism, and a receiving knife fixed at the backward position of this hook knife, and the looper thread engaging means is formed at the leading end of this hook knife.

6. An apparatus for preventing seam from raveling in a double chain stitch sewing machine of claim 3, wherein the second cutter is composed of a hook knife having a forward and backward driving mechanism, and a receiving knife fixed at the backward position of this hook knife, and a hook for hooking the looper thread consecutive to the looper from the cloth, and a hook for hooking the plurality of needle threads consecutive to the needles from the cloth through the looper are formed at the leading end of the hook knife.

7. An apparatus for preventing seam from raveling in a double chain stitch sewing machine of claim 3, wherein the first and second cutters are provided respectively with pressing springs for elastically pinching and holding the end portion of the looper thread being cut off between the hook knife and receiving knife against the hook knife.

8. An apparatus for preventing seam from raveling in a double chain stitch sewing machine of claim 2, further comprising a control mechanism for maintaining the engagement state as it is when driving the sewing machine for one stitch in the state of engagement with the looper thread by the looper thread engaging means, and then operating the first and second cutters.

9. An apparatus for preventing seam from raveling in a double chain stitch sewing machine of claim 2, wherein the first cutter is composed of a hook knife having a forward and backward driving mechanism, and a receiving knife fixed at the backward position of this hook knife, and the looper thread engaging means is formed at the leading end of this hook knife.

10. An apparatus for preventing seam from raveling in a double chain stitch sewing machine of claim 2, wherein the second cutter is composed of a hook knife having a forward and backward driving mechanism, and a receiving knife fixed at the backward position of this hook knife, and a hook for hooking the looper thread consecutive to the looper from the cloth, and a hook for hooking the plurality of needle threads consecutive to the needles from the cloth through the looper are formed at the leading end of the hook knife.

11. An apparatus for preventing seam from raveling in a double chain stitch sewing machine of claim 2, wherein the first and second cutters are provided respectively with pressing springs for elastically pinching and holding the end portion of the looper thread being cut off between the hook knife and receiving knife against the hook knife.

* * * * *